United States Patent [19]

Davies

[11] Patent Number: 4,569,522

[45] Date of Patent: Feb. 11, 1986

[54] GAMING DEVICE USING VISIBLE RANDOMIZATION

[75] Inventor: Ronald C. Davies, Ft. Lauderdale, Fla.

[73] Assignee: Digital Products Corporation, Ft. Lauderdale, Fla.

[21] Appl. No.: 448,726

[22] Filed: Dec. 10, 1982

[51] Int. Cl.[4] ..... A63F 7/02; A63F 7/30

[52] U.S. Cl. ..... 273/86 C; 273/122 A; 273/128 A; 273/138 A; 273/DIG. 28

[58] Field of Search ..... 273/11 C, 11 R, 1 E, 273/85 G, 86 B, 86 R, 86 C, 118 R, 118 A, 118 D, 119 R, 119 A, 121 R, 121 A, 125 A, 122 A, 138 A, 128 A, DIG. 28

[56] References Cited

U.S. PATENT DOCUMENTS

| | | | |
|---|---|---|---|
| 597,764 | 1/1898 | De Ribas | 273/86 C |
| 2,825,565 | 3/1958 | Hooker | 273/125 A |
| 3,909,002 | 9/1975 | Levy | 273/138 A |
| 4,153,250 | 5/1979 | Anthony | 273/86 C |
| 4,269,413 | 5/1981 | Langieri | 273/122 A |
| 4,360,203 | 11/1982 | Garbark | 273/121 A |

*Primary Examiner*—Richard C. Pinkham
*Assistant Examiner*—MaryAnn Stoll Lastova
*Attorney, Agent, or Firm*—Lerner, David, Littenberg Krumholz & Mentlik

[57] ABSTRACT

A gaming apparatus uses a group of distinctively colored marbles which are released to travel down an inclined path consisting of four mutually perpendicular segments. A series of deflecting pins are provided along the path for randomizing movement of the marbles free of any influence by the user. A series of steps and crowns are provided to prevent the marbles from being stopped by the pins. A slot is provided for accepting tokens or coins for placement of wagers with regard to the order in which the marbles will arrive at the finishing position. A mechanism is provided for identifying the sequence of finish and determining the outcome of the wagers. The movement of the marbles is at all times visible to the user to provide enjoyment and excitement.

17 Claims, 11 Drawing Figures

FIG. 3
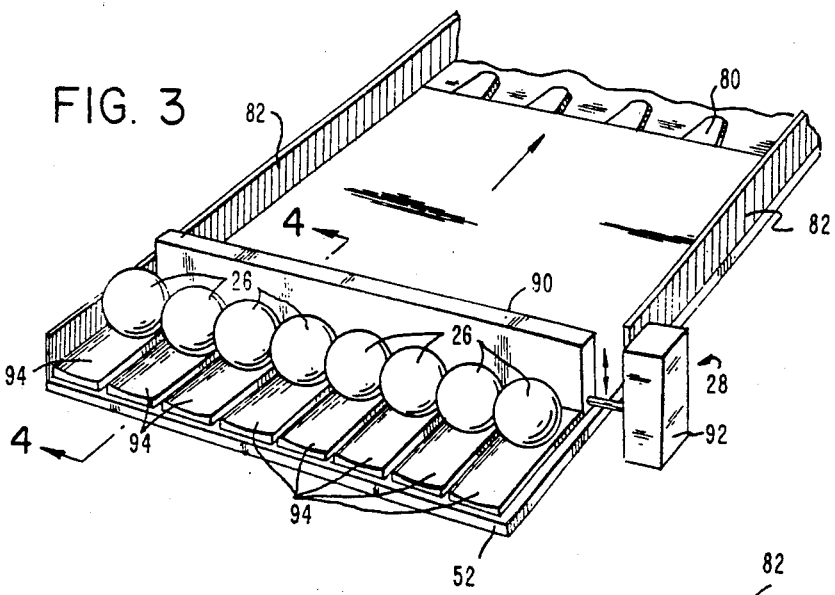
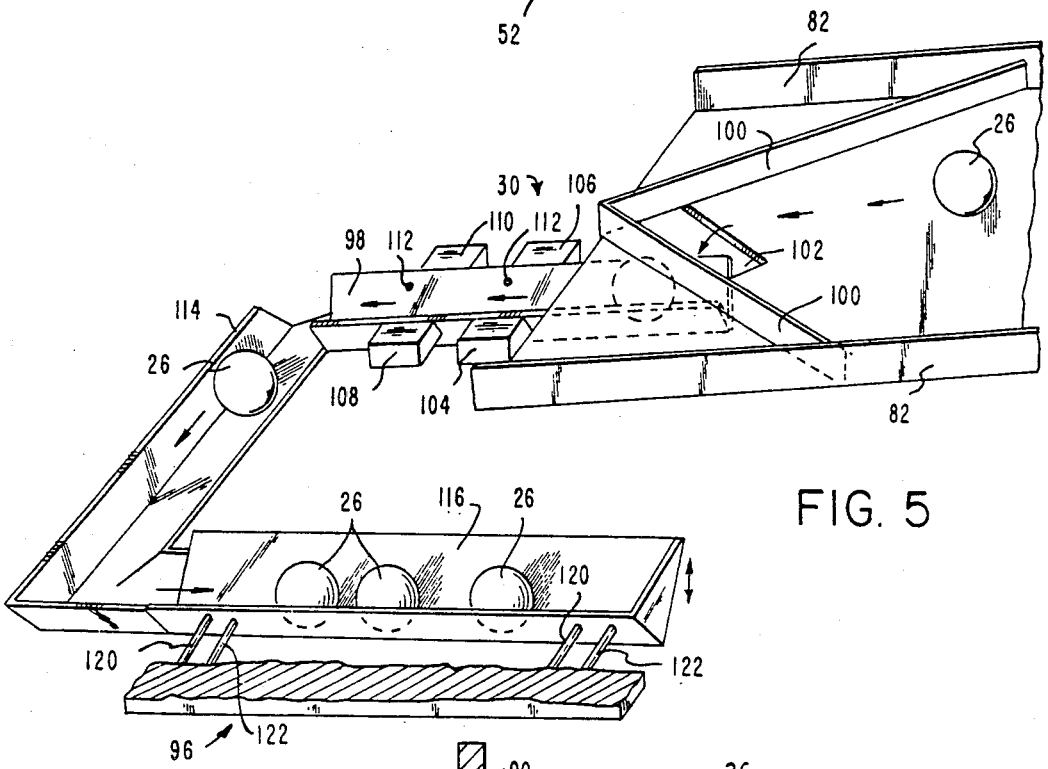
FIG. 5
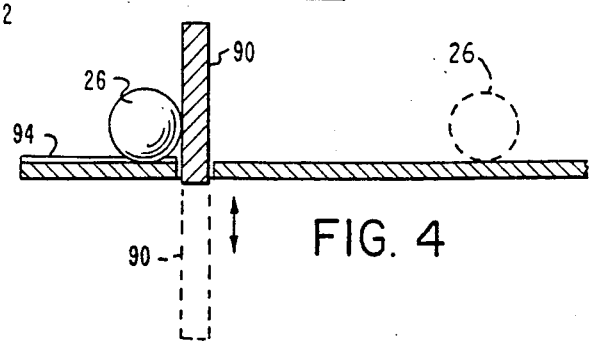
FIG. 4

GAMING DEVICE USING VISIBLE RANDOMIZATION

BACKGROUND AND/OR ENVIRONMENT OF THE INVENTION

1. Field of the Invention

The present invention pertains to gaming apparatuses, and more particularly to a gaming apparatus which employs means for randomly selecting a winner from a field of entrants, determining the winner, and providing a payout based on such selection, the selection being accomplished while the mechanism which actually causes the selection being visible to the user.

2. Description of the Contemporary and/or Prior Art

The attraction to games of chance, whether they incorporate a means for wagering or not are well known. This attraction centers, in many instances, on the user trying to predict an outcome of a randomized event. Typical of such gaming devices are those commonly known as slot machines, for instance the apparatuses shown in U.S. Pat. No. 2,010,487 issued to Hochriem on Aug. 6, 1935; U.S. Pat. No. 4,240,635 issued to Brown on Dec. 23, 1980; and U.S. Pat. No. 4,335,809 issued to Wain on June 22, 1982. Hochriem shows a mechanical slot machine and Wain and Brown show electronic slot machines. Random or pseudorandom generation of data, which determines a winner in Brown or Wain, cannot be visualized by the user since it is accomplished by an algorithm. While a spinning wheel may be simulated by the displays of these apparatuses, this is merely to enhance the attractiveness of the play and is not an actual visualization of the mechanism employed to accomplish the random determination by the algorithm. Similarly, in Hochriem the mechanical interaction of the elements thereof determines the random selection of the position of the indicia on the wheels thereof, but the mechanism by which the random selection is accomplished is not visible to the user. While the excitement provoked through the use of these apparatuses is well known, such intrigue and excitement is limited to predicting an outcome and the user is not a participant or an observer in the random selection of a winner.

Similarly, U.S. Pat. No. 1,995,137 issued to Woolard on Mar. 19, 1935 discloses an apparatus wherein a winner is selected based upon mechanical interaction of several components. Specifically, Woolard discloses a plurality of electrically driven elements, driven by an eccentric drive, which obtain particular positions dependent upon the effect of the driving of the elements. The rotation is arbitrarily stopped after a preselected time and the relative position of the elements is judged to determine the winner. Visualization of the mechanism which provides a sequencing, i.e., the eccentric drive, does not corrolate with the position of the movable elements and thus the positional location of the elements is not truly random but is periodically varied to correspond in part to the eccentricity of the cam. Furthermore, the outcome of the contest does not corrolate to the activity visualized by the user during the selection process.

In an obvious attempt to enhance the excitement of play of gaming machines, several references teach apparatuses which permit user input to vary the outcome thereof. Because of user input, the skill and acumen of the player is brought to bear on the ultimate outcome. Such references include U.S. Pat. No. 1,912,324 issued to Trasch on May 30, 1933; U.S. Pat. No. 1,971,062 issued to Burton on Aug. 21, 1934; U.S. Pat. No. 2,010,966 issued to Sieden on Aug. 13, 1935; and U.S. Pat. No. 2,188,619 issued to Bernhardt on Jan. 30, 1940.

Trasch teaches a coin operated game wherein a plurality of discs are randomly moved on a pair of rotating turntables. Through player input, the randomly moving discs are forced into a preselected position by the player. Although incorporating random movement, the random movement does not dictate the outcome of the play of the game. The outcome is instead determined by user input and manipulation of the structure of the apparatus to force one of the randomly moving discs into a preselected position.

The patent to Burton shows a gaming apparatus wherein coins are dropped into a structure of rotating columns. As the columns rotate, the user manipulates structure of the apparatus to try to open trap doors at the bottom of the columns to produce a payout. Here again, the determination of the outcome is user controlled.

In the same manner, the patent to Sieden teaches a game of skill wherein balls are rolled down inclines and are trapped in holes to actuate circuits. The trapping of the balls in holes is accomplished through skillful manipulation of the components of the apparatus by the player. In a similar manner, the patent to Bernhardt shows a plurality of electrically driven elements that are powered both by user varying of an input signal and a second input signal which is beyond the control of the user and which is varied by an eccentric mechanism that interacts with a rheostat. No random sequencing is therefore shown.

While games of skill do provide significant interaction and represent one manner to enhance excitement over blind random selection, as in the aforediscussed slot machines, many complications can arise with such apparatuses such as to the manner in which they can be used, the frequency of repairs necessary, and their suitability for licensed gaming establishments.

The present invention provides a significant advance in the gaming art by setting forth a novel construction which enhances user enjoyment and excitement by permitting visualization by the user of the actual mechanism which randomly determines the outcome thereof. Despite all the activity in the gaming arts for better than 75 years, no one has shown or suggested the use of a mechanism which will permit the user to watch the random selection of a winner and which will accept bets by the player and provide a payout based on the selection process and the bets placed.

The present invention accomplishes this by providing a gaming apparatus which includes accepting means for accepting wagers from the user as to the order in which a group of movable elements will reach the bottom of an inclined surface or surfaces, the inclined surface or surfaces having interposed thereon a plurality of deflection means which cause randomization of the outcome of the game in regard to the final arrival order of the movable elements and which includes means for determining such outcome and for making a payout based upon the outcome reconciled with the wagers placed. Because of the employment of the particular configuration of deflection means which causes randomization, the user or users can actually watch the random selection taking place as real time action and, over a preselected period of time, will be afforded the excitement, anxiety, satisfaction, and possibly disappointment as the various movable elements travel over the inclined plane and either take a lead or fall behind relative to other movable elements and specifically in regard to the movable element selected by the user. Such an enhancement in a random selection gaming device has been heretofore unknown.

The general idea of rolling marbles or the like down an incline which includes deflection pins is shown in U.S. Pat. No. 271,530 issued to Spang on Jan. 30, 1883; U.S. Pat. No. 503,318 issued to Hawkes on Aug. 15, 1893; U.S. Pat. No. 1,374,844 issued to Flatow on Apr. 21, 1921; and U.S. Pat. No. 1,531,401 issued to Kawai on Mar. 31, 1925. However, none of these references show or suggest use of an inclined plane with deflection means in a wagering type gaming apparatus which includes means for accepting wagers from a user and means for determining the outcome of the wagers. It is clear therefore that despite the teachings of inclined planes with deflection means in the toy type amusement device art those of ordinary skill in the art in constructing wagering type gaming apparatuses, despite their intense desire to create new and more exciting gaming apparatuses have not, over a significantly long period of time, found it obvious to incorporate such teachings in wagering type gaming apparatuses.

A major drawback in games such as those shown in Spang, Hawkes, Flatow, and Kawai is that it is extremely likely a rolling marble, ball, or the like will "hang up" or be caught on one of the deflection pins or similar means thereof causing one entrant to not finish a race. While this is of insignificant consequences in a toy type game it is totally unacceptable in a self-supervising gaming apparatus. The present invention overcomes this problem by providing specific means for precluding the snagging or hanging up of one of the movable elements thereof on the deflection pins or the like provided, therefore providing a significant advance over known devices.

In general, other marble racing toys are shown in U.S. Pat. No. 2,001,366 issued to Mittelman on May 14, 1935 and U.S. Pat. No. 1,018,956 issued to Bebon on Feb. 27, 1912. Rolling of marbles in single tracks are shown in U.S. Pat. No. 3,883,137 issued to Bengtson on May 13, 1975; and U.S. Pat. No. 3,451,678 issued to Gehrts on June 24, 1969. Other games which include rolling objects on sloped surfaces are shown in U.S. Pat. No. 4,153,250 issued to Anthony on May 8, 1979; and U.S. Pat. No. 3,711,094 issued to Coffman on Jan. 16, 1973. Anthony teaches a gravity type racing game wherein user input determines the outcome and Coffman teaches a rolling ball game apparatus wherein rubberband deflectors are provided to enhance a random outcome. Rubberbands are mounted on a single inclined surface at various locations thereon.

U.S. Pat. No. 930,164 issued to Eberman on Aug. 3, 1909 generally shows the use of deflection pins on an inclined surface in a pinball type game and U.S. Pat. No. 1,571,188 issued to Diegel on Feb. 2, 1976 shows a multileveled inclined surface which provides a plurality of openings into which marbles or the like can be trapped. After the marbles are trapped in the openings they are removed and stop locks are disposed therein.

In reviewing the aforenoted games which employ inclined surfaces and deflection pins or the like for effecting the order in which marbles or the like arrive at a finish point, it is to be noted that none of these apparatuses show or suggest means for determining the order in which the marbles or the like arrive at a finish point through noncontact detection and for accomplishing some wagering related activity subsequent to such a determination.

SUMMARY OF THE INVENTION

Therefore, a primary object of the present invention is to provide a gaming apparatus which includes a random outcome.

A further object of the present invention is to provide a gaming apparatus wherein the mechanism used to provide a random outcome can be watched during the randomization of the outcome to provide enhanced enjoyment.

A still further object of the present invention is to provide a gaming apparatus wherein wagers can be placed upon the outcome, the outcome is randomly determined while the user watches, and a payout based on the outcome as reconciled with the wagers is effected.

Still another object of the present invention is to provide a gaming apparatus which incorporates elements which roll over an inclined surface and are deflected thereon wherein the rolling elements are strictly precluded from hanging up on the deflectors.

Still another further object of the present invention is to provide a game apparatus which incorporates a plurality of successive elongated inclined surfaces to prolong the play of the game.

Another further object of the present invention is to provide a game apparatus which include such successive elongated inclined surfaces and a plurality of randomization means disposed both on the successive elongated surfaces and at the interfaces thereof.

Another still further object of the present invention is to provide a game apparatus wherein each of the movable elements carry an identification characteristic.

A still further additional object of the present invention is to provide a game and gaming apparatus which is simple in design, inexpensive to manufacture, rugged in construction, reliable, serviceable, and efficient in operation.

These objects as well as further objects and advantages of the present invention will become readily apparent after reading the ensuing description of a nonlimiting illustrative embodiment and viewing the accompanying drawing.

A gaming apparatus for play by a user according to the principles of the present invention comprises a group of movable elements each having a visible identification characteristic; accepting means for accepting wagers from the user as to the order in which at least one of the group of elements will arrive at a designated finishing position; path means proximate to which each of the movable elements travels between a designated starting position and a designated finishing position; randomization means associated with the path means for causing the movable element to arrive at the finishing position in a user independent random sequence as a result of the interaction of the movable elements and the randomization means, the elements being visible during the random sequencing; and determination means for determining the outcome of the bets as a result of the sequencing of the movable elements.

Further, a game apparatus according to the principles of the present invention wherein movable elements roll down an inclined surface comprises an inclined surface having an upper and lower end; a plurality of deflecting pin means associated with the inclined surface for altering the paths of the movable elements as the movable elements roll from the upper end to the lower end of the inclined surface; and precluding means for precluding the movable elements from being stopped by the pin means when rolling from the upper end to the lower end of the inclined surface.

A game apparatus wherein movable elements roll down a plurality of inclined surfaces according to the principles of the present invention comprises a plurality of successive elongated inclined surfaces; and randomization means for causing the movable elements to arrive at the lowermost portion of the last inclined surface in random sequence as a result of the impactive interaction of the movable elements and the randomization means, the randomization means being disposed adjacent to the uppermost portion of each of the plurality of successive elongated inclined surfaces adjacent to the lowermost portion of an adjacent elongated inclined surface.

BRIEF DESCRIPTION OF THE DRAWING

In order that the present invention may be more fully understood, it will now be described, by way of example, with reference to the accompanying drawing in which:

FIG. 3 is a partially broken away perspective view of the starting gate of the present invention;

FIG. 4 is a cross sectional view taken substantially along the lines 4—4 of FIG. 3;

FIG. 5 is a partially broken away fragmentary perspective view of the apparatus of the present invention which sequences identifies the rolling elements thereof;

DESCRIPTION OF THE PREFERRED EMBODIMENT

The present invention provides a gaming apparatus for play by a user which permits one or more users to wager on a random outcome event. A particularly notable feature of the invention is found in the user or users being able to observe the phenomenon which creates the random outcome while the elements thereof undergo this randomization. Specifically, a plurality of inclined planes are provided which provide randomizing obstructions and flexible walls such that when a plurality of movable elements such as marbles or the like are rolled down the successive inclined planes, the first marble to reach a preselected location at the bottom of the last inclined plane does so on a random basis. The order in which the marbles or the like reach the preselected location is detected by detector means that differentiates the different colors of the marbles. Based on the finishing order of the marbles, the wagers are reconciled with this order and a return, if earned, is paid.

The previously described general arrangement can be enhanced by various types of graphics and themes as desired. For instance, the apparatus may be cast in a horse racing motif where suitable graphics and horse racetrack structure is incorporated in the basic apparatus. Similarly, the apparatus may be employed in a car racing environment with the marbles or the like representing race cars and the inclined surfaces on which the marbles roll being provided with car racetrack scenery. Such enhancements do not alter the essential character of the device, may be so elaborate as to include musical accompaniment or the like, and are within the principles and scope of the present invention.

Figure 1:
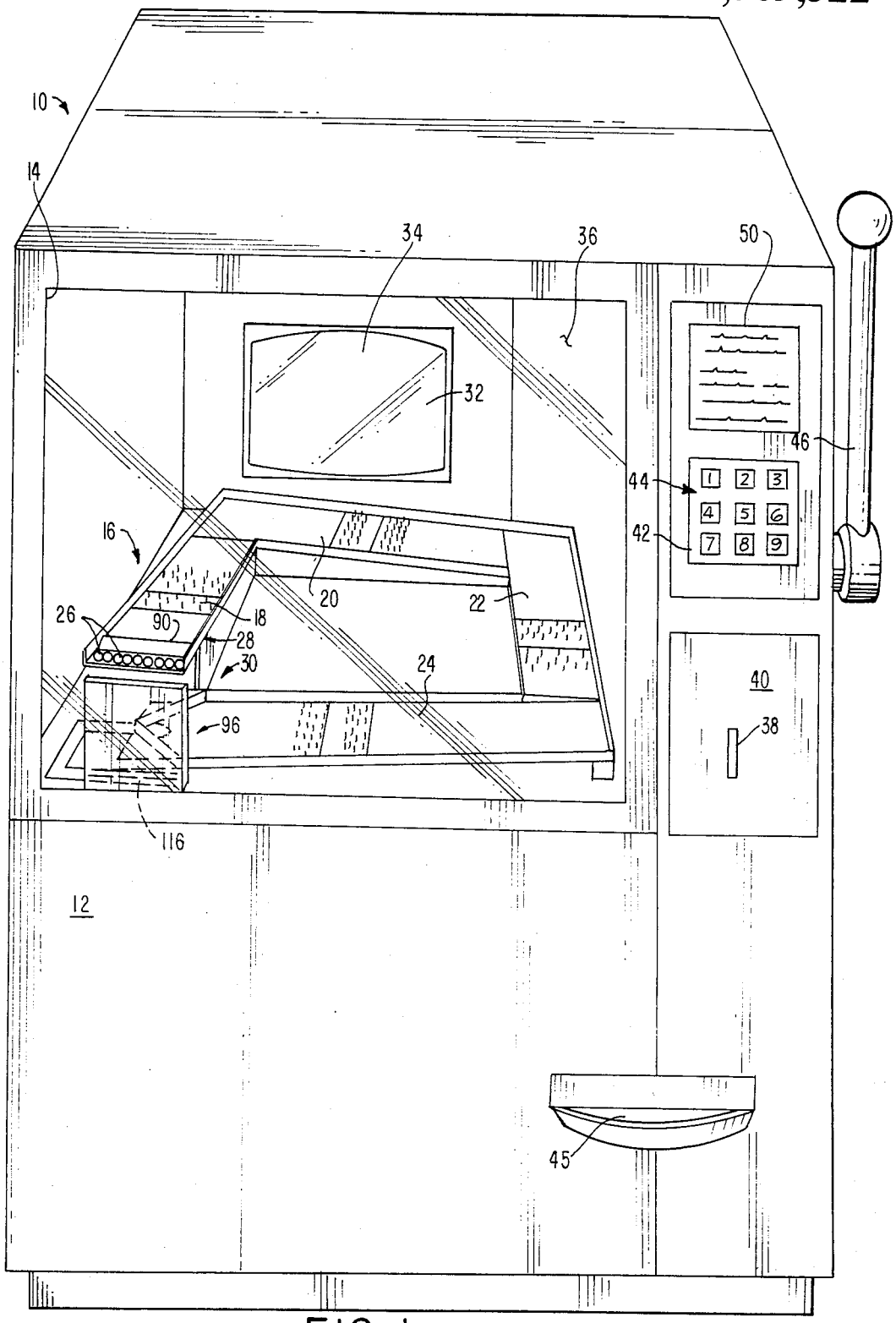
FIG. 1 is a perspective view of the preferred embodiment of the present invention incorporating the principles thereof therein.

Referring now to the figures, and more particularly to FIG. 1 thereof, there is illustrated a gaming apparatus 10 which incorporates the principles of the present invention therein. Apparatus 10 includes a display case 12 forming a viewable compartment 14 therein at the upper portion thereof. The lower portion of the display case 12 is provided to house the balance of the apparatus which does not necessarily have to be visible to the user.

Disposed within the visible compartment 14 is a track 16 which comprises a plurality of successive inclined surfaces 18, 20, 22, and 24. The successive inclined surfaces 18 through 24 provide inclined upper surfaces having large planar portions on which a plurality of marbles 26 can roll. A starting gate mechanism 28, hereinafter discussed in conjunction with FIG. 3, is provided at the uppermost end of the successive inclined surface 18 and a finish order mechanism 30, hereinafter discussed in conjunction with FIG. 5, is provided at the lowermost end of the successive inclined surface 24. The various details and features of the track 16 will be hereinafter discussed in conjunction with FIGS. 2 through 8. Also disposed within the viewable compartment 14 of the gaming apparatus 10 is a video display 32, the screen 34 of which is visible to the user through a window 36 provided on the face of the display case 12.

Mounted on the display case 12, and accessible to the user or users is a token slot 38 of a token accepting means 40, hereinafter described; keyboard 42 of a wagering input device 44; a token delivery chute 45 and an activation arm 46 which is part of the game start input device 48, illustrated in FIG. 9. Suitable instructions 50 are also provided to describe to the user or users the functioning of the gaming apparatus 10 and the manner in which wagers can be made.

It is to be understood that the particular shape and configuration of the display case 12 and the location of the user accessible components mounted thereon have been shown merely for purposes of illustration and that various other configurations may be employed, as desired, within the principles and scope of the invention. For instance, the video display 32 may be provided on top of the display case 12 or may be otherwise situated and the display case 12 can be differently shaped. In addition, the activation arm 46 may be differently located or otherwise configured, for instance as a switch, as desired.

The general operation of the gaming apparatus will be described in conjunction with FIG. 9, but first a detailed description of the mechanical aspects of the track 16 and the mechanisms associated therewith will be described.

Figure 2:
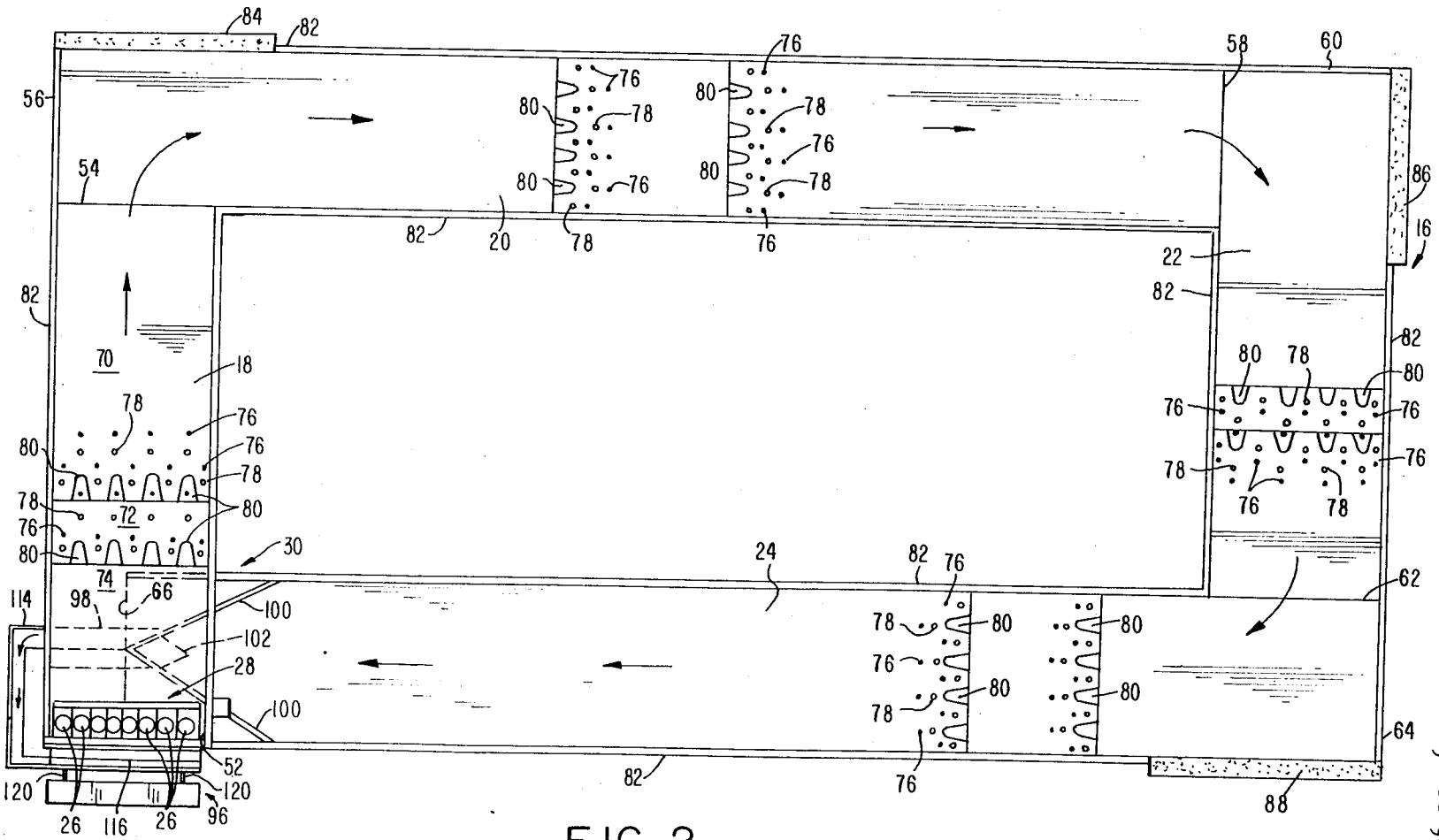
FIG. 2 is a top plan view of the successive inclined surfaces of the present invention.

Referring now to FIG. 2, a top view of the track 16 is illustrated therein. The track 16 is seen to comprise the successive inclined surfaces 18, 20, 22, and 24. The uppermost end 52 of the successive inclined surface 18 has disposed adjacent thereto the starting gate mechanism 28. The lowermost end 54 of the successive inclined surface 18 laterally abuts the uppermost end 56 of the successive inclined surface 20. Similarly, the lowermost end 58 of the successive inclined surface 20 abuts the uppermost end 60 of the successive inclined surface 22 and the lowermost end 62 of the successive inclined surface 22 abuts the uppermost end 64 of the successive inclined surface 24. The lowermost end 66 of the successive inclined surface 24 is disposed underneath the portion of the successive inclined surface 18 adjacent to the uppermost end 52 thereof. As a result of this configuration, a successive path of travel is provided wherein, when the marbles 26 are released by the starting gate mechanism 28, the marbles 26 can successively travel from the inclined surface 18 to the inclined surface 20 then to the inclined surface 22 and finally to the inclined surface 24.

Each of these successive inclined surfaces 18 through 24 are constructed of Lexan or the like and comprise a plurality of overlaid planar sections which create steps in the inclined surface 18 through 24 and associated stepped portions in the proximity of the step. For example, and indicative of the construction of successive inclined surfaces 20, 22, and 24, the successive inclined surface 18 includes a first planar section 70 overlaid by a second planar section 72 which in itself is overlaid by a third planar section 74. A combination of the first, second, and third planar sections 70 through 74 presents an inclined surface which is stepped as aforedescribed. Although a particular manner of providing such a stepped construction has been hereinbefore described, it is to be understood that those of ordinary skill in the art may use other methods and constructions for producing the stepped arrangement. For instance, the track 16 could be cast or manufactured as a uniform structure.

Adjacent to the stepped portions of each of the successive inclined surfaces 18 through 24 are a plurality of pins 76, crowns 78, and steps 80. The purpose of the pins 76, crowns 78, and steps 80, and the stepped portions of the successive inclined surfaces 18 through 24 are to randomize the movement of the marbles 26 as they roll down the track 16. The arrangement and relationship of the pins 76, crowns 78, steps 80, and stepped portions of the successive inclined surfaces 18 through 24 will be hereinafter discussed in conjunction with FIGS. 7 and 8. Nonetheless, it is to be understood that these components may be arranged in different locations around the track 16 and at different positions on the successive inclined surfaces 18 through 24 as desired.

The term marbles as used herein is meant to be descriptive of any movable element which can proceed, under influence of gravity, around the track 16. In the preferred embodiment, the marbles comprise nonmagnetizable steel balls which are encapsulated with colored nylon or the like, the purpose of which will be hereinafter discussed. Of course, the marbles must be uniform in size and weight if a truly random outcome is to be provided.

The successive inclined surfaces 18 through 24 are each rectangular in shape as illustrated and are positioned such that the longitudinal axis of each are perpendicular to the longitudinal axis of the adjacent inclined surfaces. Specifically, the longitudinal axis of the successive inclined surface 18 is substantially perpendicular to the longitudinal axis of the successive inclined surface 20, the longitudinal axis of the successive inclined surface 20 is substantially perpendicular to the longitudinal axis of the successive inclined surface 22 and the longitudinal axis of the successive inclined surface 22 is substantially perpendicular to the longitudinal axis of the successive inclined surface 24. The inclined surfaces 18 through 24 can be supported and maintained in position by any suitable mountings.

The lateral edges of the successive inclined surfaces 18 through 24 are bounded by upstanding walls 82 which serve to keep the marbles 26 on the track 16. One of the walls 82 of the successive inclined surface 20 includes a semi-resilient portion 84 adjacent to the uppermost end 56 of the successive inclined surface 20 and also adjacent to the lowermost end 54 of the successive inclined surface 18. The purpose of the semi-resilient portion 84 is to further randomize movement of the marbles 26 when they first arrive upon the successive inclined surface 20. As the marbles 26 travel down the successive inclined surface 18, they are propelled into the semi-resilient surface 84 and bounce thereoff. This bouncing causes various collisions between the marbles 26, and the walls 82 causing a randomization of travel. By employing this randomization means any distance advantage a marble may have by traveling around the inside of the track 16 rather than the outside of the track 16 is avoided.

In a similar manner, a semi-resilient portion 86 is provided in the wall 82 associated with the successive inclined surface 22 adjacent to the uppermost end 60 thereof and the lowermost end of the successive inclined surface 20. Also, a semi-resilient portion 88 is provided in the wall 82 associated with the successive inclined surface 24 adjacent to the uppermost end 64 thereof and the lowermost end 62 of the adjacent successive inclined surface 22. Of course, it is to be understood that other randomization means may be employed as are well known to those skilled in the art. The semi-resilient portions 84 through 88 can be constructed of any suitable material such as plastic, natural or synthetic rubber, or the like, the degree of resiliency of these portions being selected and matched to the nature and weight of the marbles 26 and the desired deflection required. It is also to be understood that the track 16 may be configured other than as shown, for instance the track could be rounded, could be one long section rather than several, and could provide various undulations as desired so long as somewhere between the uppermost portion of the track 16 and the lowermost portion of the track 16, the marbles 26 undergo a randomization.

The starting gate mechanism 28 is located adjacent to the uppermost end 52 of the successive inclined surface 18 and includes a starting gate 90 controlled by a starting gate release 92. The starting gate release 92 includes a suitable means, such as a solenoid drive or the like, for reciprocating the starting gate above and below the successive inclined surface 18, such mechanisms being well known. With reference to FIG. 4, it can be seen that the starting gate 90, when above the successive inclined surface 18, precludes passage of the marbles 26 and, when lowered into the position shown in phantom permits passage of the marbles 26. The starting gate release 92 is controlled as further described in conjunction with FIG. 9.

Figure 6:
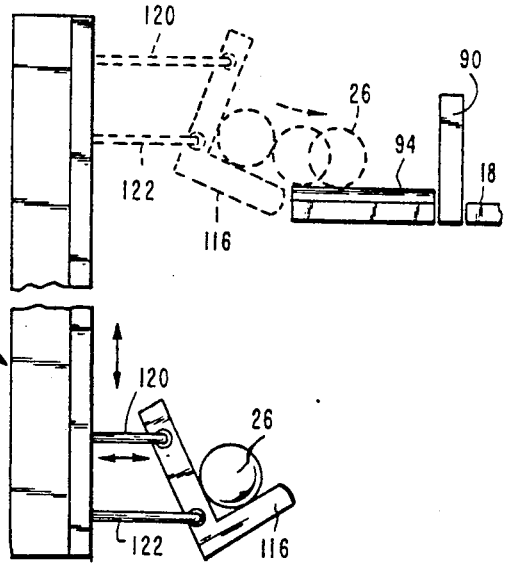
FIG. 6 is a partially broken away side view of the recycling and restarting mechanism of the present invention.

Just above the starting gate 90 on the inclined surface 18 are a plurality of marble troughs 94 into which the marbles 26 are placed by recycling mechanism 96, hereinafter described in conjunction with FIG. 6. Although a particular starting gate 90 and starting gate release 92 is illustrated, of course differently configured starting gates may be employed within the principles and scope of the invention. The troughs 94 serve to evenly space the marbles 26 laterally and to permit them to begin their travel absent interaction with each other. It should be understood that while eight marbles 26 and troughs 94 are illustrated that a different number may be employed as desired.

Shifting to the finish of the marble race, a finish order mechanism 30 is disposed adjacent to the lowermost end 66 of the inclined surface 24 shown in FIG. 2, and as further illustrated in FIG. 5. The finish order mechanism 30 must cause the marbles 26 to fall into a substantially V-shaped conduit 98 one at a time. The finish order mechanism includes a pair of upstanding walls 100 which form a V-shaped guide configuration. Disposed through the inclined surface 24, adjacent to the vertex of the walls 100, is an opening 102 sized to permit the marbles 26 to fall one at a time therethrough. In addition, the opening 102 is located as illustrated and is of sufficient size such that the marbles 26 cannot arrive at the vertex of the walls 100 side by side causing a jam. Various other configurations for the finish order mechanism 30 are possible so long as the marbles 26 are provided to the substantially V-shaped conduit 98 one at a time.

Mounted on the substantially V-shaped conduit 98 are a light source 104 for interaction with a reflected light detector 106 and a light source 108 for interaction with an interrupted light detector 110. Apertures 112 are provided and are disposed through the substantially V-shaped conduit 98 to permit shining of the light sources 104 and 108, respectively, on the reflected light detector 106 and the interrupted light detector 110 as further illustrated in FIG. 10.

Ignoring for the moment the operation of the detectors 106 and 110, after the marbles 26 travel the length of the V-shaped conduit 98, which is sloped, they fall into a sloped V-shaped conduit 114 disposed at right angles to the V-shaped conduit 98. The V-shaped conduit 114 permits the marbles 26 to roll therealong and to be delivered into a lift element 116 of the recycling mechanism 96, as further illustrated in FIG. 6. A substantially V-shaped conduit is employed for conduit 98 because it allows for precise positioning of the marbles 26 relative to the reflected light detectors 106 and 110 so that their respective operations can be accomplished. An alternate configuration can be provided so long as the positioning of the marbles 26 is adequate for the interruption and reflected light detection functions to be accomplished.

The recycling mechanism 96 is provided to move the marbles 26 from their finished position back to positions on the troughs 94 for play of another game. Recycling mechanism 96, as illustrated in FIG. 6, includes a drive means 118 having two pairs of upper and lower arms 120 and 122 pivotally affixed to the lift element 116, as also shown in FIG. 5. The drive means 98, when activated, causes the arms 120 and 122 to move the lift element 116 vertically until the marbles are slightly above the level of the marble troughs 94. The upper arms 120 are then extended and the pivotally affixed lift element 116 is caused to tilt forcing the marbles 26 therefrom onto the marble troughs 94. The upward movement of the arms 120 and 122, and the extensive movement of the of the arms 120, can be accomplished by any suitable drive means well-known in the art. Additionally, other construction such as a carousel configuration or other lifting can be employed to transport the marbles 26 from their finish position back to the marble troughs 94 for replay of the gaming apparatus 10.

Figure 7:
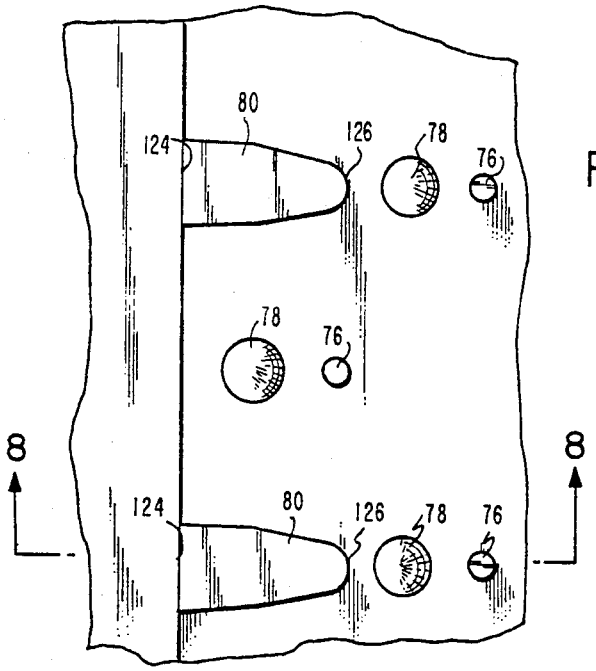
FIG. 7 is an enlarged fragmentary view of the pin, crown, and step arrangement of the present invention.
Figure 8:
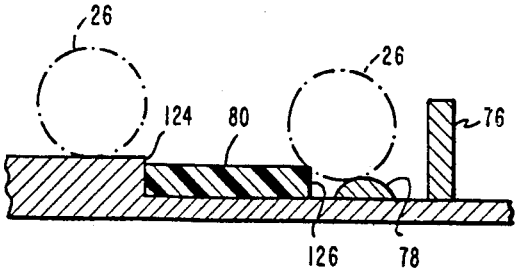
FIG. 8 is a cross sectional view taken substantially along the lines 8—8 of FIG. 7.

As previously mentioned, the marbles 26 are precluded from "hanging up" or being caught by the pins 76 through interaction of the pins 76 with the crowns 78 and steps 80, as well as the stepped portions of the successive inclined surfaces 18, 20, 22, and 24. With reference to FIGS. 7 and 8, which are representative of the variously located pins 76, the pins 76 are seen to be substantially cylindrical in shape and the crowns 78 are seen to be semi-spherical in shape. The stepped portions of the inclined surfaces 18 through 24 provide a sharply defined vertical edge 124. The steps 80 provide a curved but vertically disposed edge 126.

The crowns 78 are spaced from the associated pins 76 a distance which is less than the radius of the marbles 26. The distance between the crowns 78 and the edges 124 and 126, respectively, of the steps 80 or the steps formed by the sections of the inclined surfaces 18 through 24 is also less than the radius of the marbles 26. The distance between the edges 124 and 126 respectively, of the stepped portions of the inclined surfaces 18 through 24 and the steps 80 and the associated pins 76 is greater than the radius of the marbles 26. As a result, the marbles cannot "hang up" on or be caught by the pins 76 because the rolling contact between the semi-spherical surfaces thereof and the spherical surface of the marbles 26 precludes such an event. The marbles 26 cannot be caught by the crowns 78 because of the interaction of the edges 124 or 126 and the spherical and semi-spherical surfaces, respectively, of the marbles 26 and the crowns 78. As a result, a configuration is provided wherein the marbles 26 are deflected to cause the aforedescribed desired randomization but are not subject to jamming, a condition which would defeat the use of the configuration of the present invention as a self-supervised gaming apparatus.

While the pins, crowns, and steps are shown in a particular positional relationship it is to be understood that one of ordinary skill in the art could modify such relationship within the principles and scope of the invention. Furthermore, it is to be understood that these components could be constructed of various materials and could be appropriately modified as desired. While the elements 76 have been characterized as pins, it is to be understood that this terminology is to be broadly interpreted and includes elements variously called bumpers, deflectors, knobs, etc.

Keeping in mind the aforegoing description of the general operation of the present invention and the specific mechanical details relating to the track 16 and travel of the marbles 26 therearound, the details of the electrical circuitry of the present invention will be discussed with specific reference to FIG. 9. The heart of the electrical system of the present invention is a system control microprocessor 128. The system control microprocessor 128 reacts to various control devices by accepting signals from various peripheral devices which sense certain conditions and also controls various peripheral devices to behave in response to observed conditions and a selected operational routine. The configuration of such a computer system with peripheral input devices and which outputs signals to trigger different mechanisms is well known in the art.

Although it is contemplated that the desired system would be produced on a dedicated microprocessor chip, it is equally possible to program an existing general purpose computer system to perform the desired functions. For instance, any of the smaller microprocessor computers such as the Apple, the IBM PC, etc. can readily be employed to accept input signals and to perform desired functions in response to those signals and provide outlet signals for controlling remote devices. For example, there presently are interfaces and programs which, when sensing certain stimulus through detectors, will cause the activation or deactivation of electrical devices. A typical application of such programs is in security surveillance and for supervision of various manufacturing apparatuses. Because of the widespread knowledge available in regard to such basically simple systems, no further disclosure as to the operation and programming of such systems shall be contained herein.

The system control microprocessor 128 receives inputs from the token accepting apparatus 40, the game start input device 48, the wagering input device 44, and from a marble identification circuit 130 hereinafter described in conjunction with FIGS. 10 and 11. Control signals are sent from the system control microprocessor 128 to a payout mechanism 132, a token delivery chute 45 which is illustrated in FIG. 1, and the recycling mechanism 96. In addition, a video display signal, generated through means well known in the art, is provided to the video display 32.

In operation, the user can enter his wager into the wagering input device 44 via the keyboard 42 thereof. Depending upon the environment in which the gaming apparatus 10 is cast, as previously discussed, the wagering might take different forms. The wagering could be for the winning of the race by a specific marble or could, if the game was cast in a horse racing environment, be for choosing various combinations of different finishing times. For instance, exactas, trifectas, etc. could be accepted by the input wagering device 44. The amount of the wagers is controlled by the tokens inserted into the token slot 38 of the token accepting apparatus 40 which sends a signal corresponding to the amount deposited to the system control microprocessor 128. Apparatuses which provide signals upon deposit of tokens and which distinguish different tokens are well known in the art and will not be herein discussed. The term token as used is meant to apply to privately minted objects which are exchanged for money as well as actual currency. The wager and the amount thereof is displayed on the video display 32 by the system control microprocessor 128. It is to be understood that the possibility of more than one individual wagering on each race or the same individual making different wagers on the same race can also be accommodated and that the payout can be of the progressive type if desired.

Next, the user would pull the activation arm 46 of the game start input device 48, this signaling the system control microprocessor 128 to activate the starting gate mechanism 92 to open the starting gate 90. The marbles 26 are then released and travel around the track 16 as previously noted. When the marbles 26 reach the finish order mechanism 30 they are passed one at a time through the substantially V-shaped conduit 98 for identification by the marble identification circuit 130. The marble identification circuit 130 provides a signal to the system control microprocessor 128 for each marble 26, the signals varying in intensity to correspond to the particular marble identifications. By looking at these signals, the system control microprocessor 128 supplies the finishing sequence of the marbles 26 and can then calculate the payout to be made by the payout mechanism 132. Delivery of tokens or the like by a payout mechanism is well known in the art. At the same time the payout mechanism 132 is activated, the system control microprocessor 128 can also display the amount of the payout on the video display 32.

The system control microprocessor 128 also can selectively send a signal to the recycling mechanism 96 to cause the marbles 26 to be transported to their starting position as desired. The recycling mechanism can be employed at the end of each race or can be activated upon acceptance of a wager.

Figure 10:
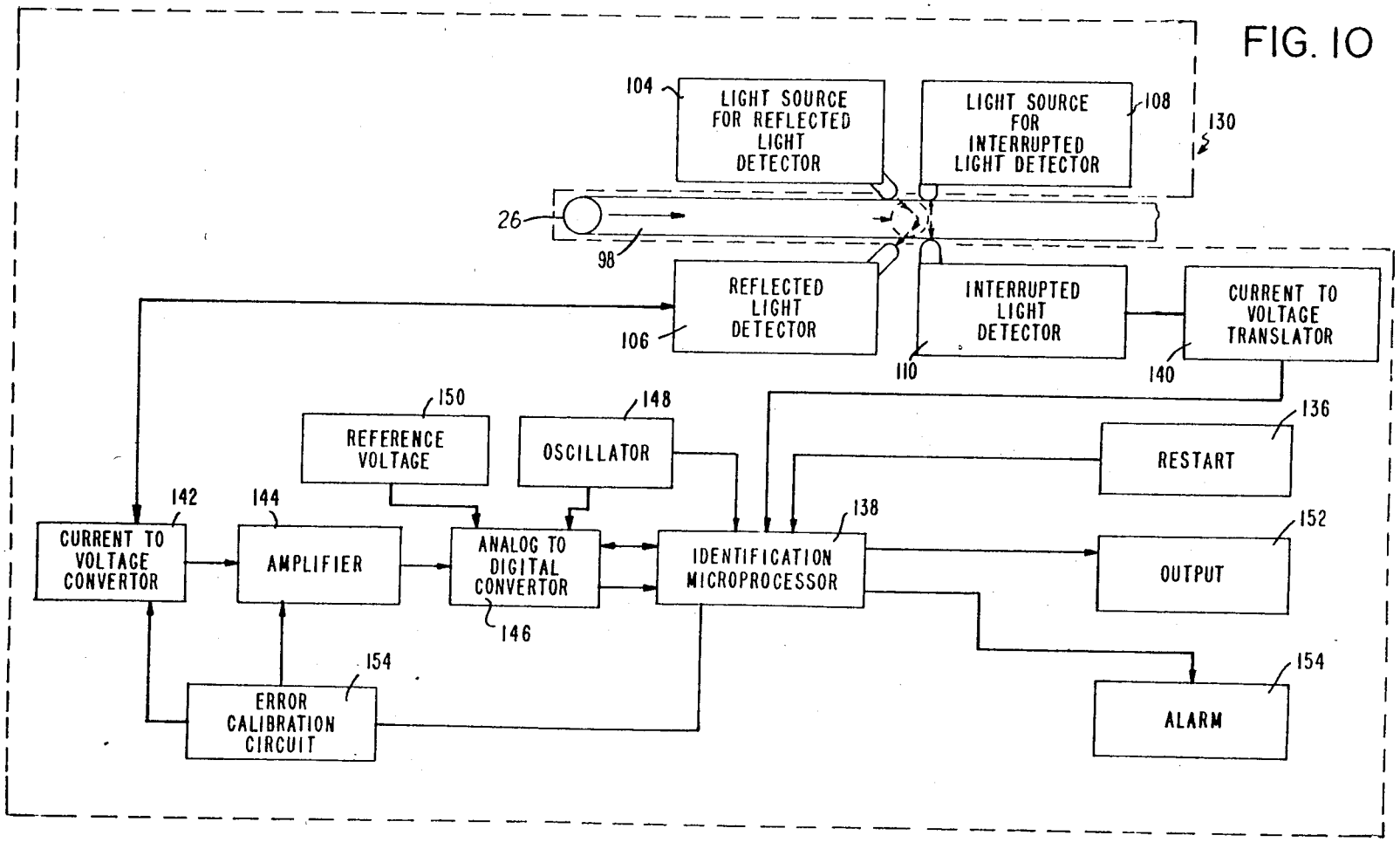
FIG. 10 is a block diagram of the electronic means for identifying the particular balls of the present invention.
Figure 11:
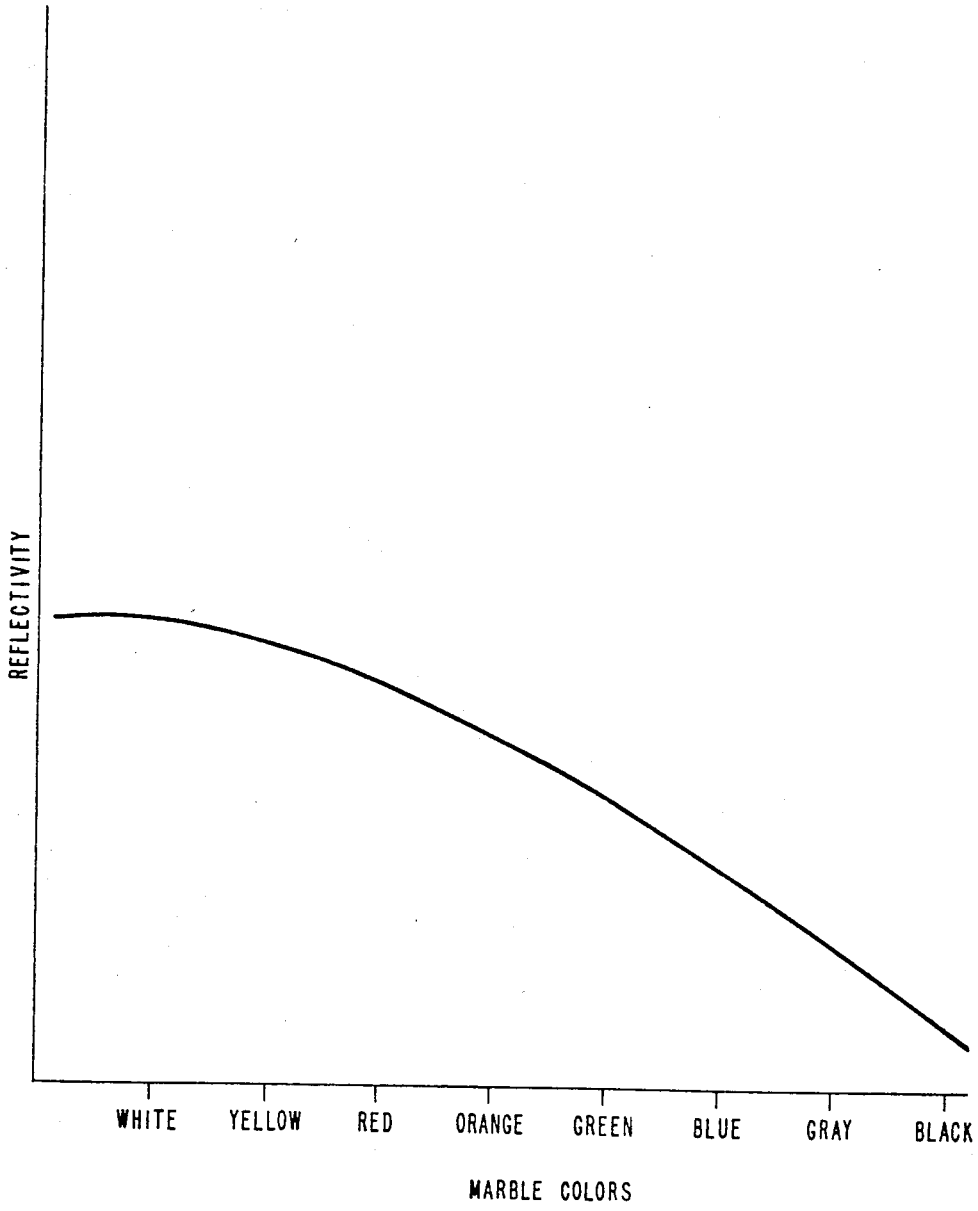
FIG. 11 is a graphic representation of the color versus reflecting characteristic of the present invention.

The marble identification unit 130 is illustrated in FIG. 10 and is constructed of standard and widely available components well-known to those of ordinary skill in the art. The marble identification unit 130 may be a dedicated unit or the control features can be combined in the same computer system as the system control microprocessor 128. The unit 130 includes the previously mentioned light source 104 and associated reflected light detector 106 and light source 108 and associated interrupted light detector 110. The light sources 104 and 108 and detectors 106 and 110 are disposed proximate to the substantially V-shaped conduit 98 such that the light beam provided by the light source 108 is interrupted when a marble 26 rolls down the V-shaped conduit 98 and such that the light from the light source 104 is reflected by the marbles 26, onto the reflected light detector 106, when the marbles 26 are disposed in a preselected position along the conduit 98. The marbles 26 are each covered with a differently colored material, preferably white, yellow, red, orange, green, blue, gray, and black. The reflectivity of these colors are different as illustrated in FIG. 11.

The marble identification unit 130 measures the peak value of the reflected light and transforms it into digital signals that are stored by the identification microprocessor 138 to be used to determine the color of a passing marble. The actual peak value of the reflectivity of the marbles 26 is not measured but instead, the relative peak electrical value produced by each marble 26 is compared and in that manner the marbles 26 are identified through these comparisons. Although absolute values of the reflectivity of the marbles 26 are not used in determination of their color, they can be used for calibration circuits or the like. Because relative values are used, several distinct advantages are provided.

First of all, aging of the reflected light source does not become a critical factor in determining the color of the marbles 26. When aging occurs, the relative values of each marble lowers proportionally. In addition, foreign matters such as soil and dust which can collect on the reflected light source and detector will attenuate the signal of the marbles 26 equally. Similarly, soil or marks on the marbles 26 themselves which attenuate their peak values do not cause any problems as long as the values do not go beyond the ranking dictated by evaluation of the relative values. Because of the relative ranking of reflectivity, moderate drift in the electronic circuitry which causes the absolute reflectivity values of the marbles 26 to change will not cause errors. Such drift can be associated with temperature, humidity, or component aging. A further positive characteristic is that selection of the color of the marbles 26 is not particularly critical since exact colors do not have to be matched to match absolute values. Finally, circuit design is simpler because drift, noise, and environmental stability is less critical.

The marble identification unit 130 recognizes the colors of the marbles 26 while they are rolling. This presents a distinct advantage in that the cycle time from one race to another is not delayed while the marble colors are recognized. In addition, the need for a multiplicity of detectors to measure stationary marbles is avoided.

Figure 9:
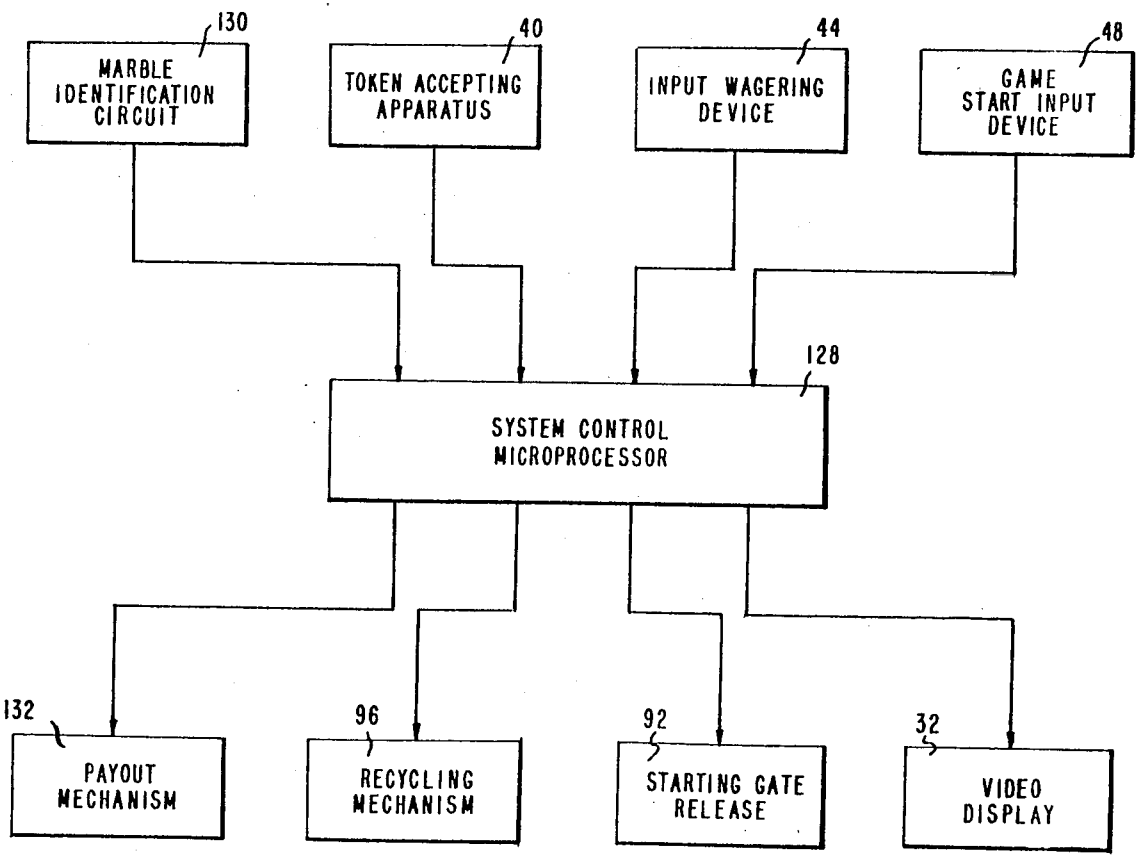
FIG. 9 is a block diagram of the interaction of the various components of the present invention.

The marble identification unit 130 is generally in a standby mode until provided with a restart signal 136 provided by the system control microprocessor 128 shown in FIG. 9. Prior to this initialization, the light souces 104 and 108 are not activated to extend their life. When the start of the race begins, an identification microprocessor 138 looks for an interrupt signal from the interrupted light detector 110. The interrupted light detector 110 is an infrared phototransistor that is physically aimed at an infrared emitting LED in the light source 108. When a passing marble 26 blocks the path of light from the light source 108 to the light detector 110, its output drops to almost zero. This lack of output current is changed to a corresponding voltage level shift, via a current to voltage translator 140. The voltage signal is then fed to the identification microprocessor 138 and provides the interrupt signal thereto.

Once the marble 26 stops interrupting the light source 108, the output from the interrupted light detector 110 resumes and the identification microprocessor 138 will therefore be in a non-ball recognition state.

The reflected light detector 106 is an infrared phototransistor that is operated in a linear and stable mode as a current generator. In this application, the reflected amount of light from the passing marbles 26 will produce a proportional reflected light signal which is coupled to a current to voltage convertor 142. The reflected light is initiated from an infrared LED disposed in the light source 104. A reflected light signal provided by the reflected light detector 106 is in the form of a current that is constantly being changed to a usable voltage by the current to voltage convertor 142 and then which is amplified by an amplifier 144. The current to voltage converter 142 and the amplifier 144 have variable parameters in that the current to voltage converter 142 has adjustable gain and the amplifier 144 has a base line adjustment, both well known in the art. These variable parameters are mechanically adjusted when the system is initially set up to match certain tolerances of the gain and leakage current specifications of the phototransistor reflected light detector 106 to produce similar operating signals from one unit to another. The gain adjustment on the current to voltage convertor 142 is initially set to produce a specified overall circuit gain. The base line adjustment of the amplifier 144 is used to compensate for leakage current of the phototransistor of the reflected light detector 106 and to establish a specified reference voltage or base line for ambient light or a no marble condition. When a marble 26 passes under the reflected light detector 106, the voltage signal is increased from the base line voltage to a peak voltage and its amplitude is established by the amount of light reflected and multiplied by the overall circuit gain.

The adjustable parameters of the current to voltage converter 142 and amplifier 144 can be automatically adjusted as specified by the identification microprocessor 138 via error calibration circuitry 154. Specified absolute values would be compared to the relative race results after each race and the compensating adjustments to the gain and base line can be made as necessary.

The output of the amplifier 144 is fed to an analog to digital convertor 146 of conventional design. The voltage signal from the amplifier is in the form of an analog signal which must be converted to a digital signal before it can be stored in the identification microprocessor 138. This is accomplished when the analog to digital converter 146 is requested to do so by the identification microprocessor 138 via a conventional handshaking routine. The speed of the analog to digital converter 146 to complete its task is governed by an oscillator 148. When the analog to digital converter 146 is finished with its task, a digiytal signal, that is proportional to its analog input, is sent to the microprocessor 138. This signal input is compared to a reference voltage 150 to establish the incremental value, in binary form, for each conversion associated with each marble 26. The reference voltage 150 must be fairly stable and noise-free.

Peak values of the data supplied by the analog to digital converter 146 are stored in the memory of the identification microprocessor 138 until all the marbles 26 have passed the reflected light detector 106. At the end of the race, the relative comparisons are made by the microprocessor 138 to determine the results of the race and are provided as an output 152. The output 152 is coupled to the system control microprocessor 128, as shown in FIG. 9, so that its functions can be accomplished.

If for some reason the data collected from the marbles happens to fall outside the predefined boundaries set forth in the aforenoted program, the identification microprocessor 138 provides an alarm signal 154 to the system control microprocessor 128 to shut down the system and trigger an alarm.

The interrupted light detector 110 and light source 108 are employed to signal the microprocessor 138 that a marble 26 is going down the conduit 98 to show that data should be taken from that moment until the marble has passed and the peak value has been stored so that the microprocessor 138 does not have to be concerned with the finish time of the marbles 26 or the increment of time between the marbles 26. The identification microprocessor 138 just has to wait until a trigger from the interrupted light detector 110 is supplied.

As each marble 26 passes past the reflected light detector 106, a signal is generated that slopes positive as the marble 26 reaches its peak and then slopes negative as the marble 26 continues to pass by the reflective sensor. The reflected signal of the same colored marble will always reach the same peak value for each game no matter how fast the marble 26 is traveling. This is why the microprocessor 138 will sample the data of a passing marble 26 until its peak has been detected and stored. By detecting only the peak of the marble's reflection, the speed of the marble 26 becomes of small concern since the sampling of data is on a higher order to magnitude than the marble's actual speed of travel.

Although a specific configuration electrical circuit has been shown to accomplish the detection of the identifying characteristic of the marbles 26 it is to be understood that other suitable means may be substituted therefore within the principles and scope of the present invention.

It will be understood that various changes in details, materials, arrangement of parts and operational conditions which have been herein described and illustrated in order to explain the nature of the invention may be made by those skilled in the art within the principles and scope of the invention.

Having thus set forth the nature of the invention, what is claimed is:

1. A gaming apparatus for play by a user comprising:
a group of spherical movable elements each having a visible identification characteristic;
accepting means for accepting wagers from the user as to the order in which at least one of said group of elements will arrive at a designated finishing position;
visible inclined path means between a designated starting position and said designated finishing position, said movable elements traveling said path means free of any user influence while said movable elements are visible, said path means including stepped portions;
user independent randomization means including an upstanding pin mounted on said inclined path means within a distance of approximately twice the diameter of one of said movable elements from one of said stepped portions and a semi-spherical crown mounted on said inclined path means between said one of said stepped portions and said upstanding pin such that a movable element traveling from said designated starting position to said designated finishing position passes over said stepped portion and said crown and then encounters said pin associated therewith to alter the speed and direction of travel of said movable elements thus causing said movable elements to arrive at said finishing position in a user independent random sequence solely as a result of the interaction of said movable elements and said randomization means; and
determination means for determining the outcome of said wagers as a result of the sequence of finishing.

2. A gaming apparatus in accordance with claim 1, further comprising payout means for making payouts based on the wagers accepted by said accepting means and the outcome as determined by said determination means.

3. A gaming apparatus in accordance with claim 2, wherein said accepting means comprises token accepting means and control means activated by said token accepting means, said control means for registering the value of said tokens and at least one user wager as to the order in which at least one of said group of elements will arrive at said designated finishing position.

4. A gaming apparatus in accordance with claim 3, wherein said accepting means further comprises display means for displaying said at least one wager.

5. A gaming apparatus in accordance with claim 3, wherein said payout means is operably coupled to said control means and said determination means, and wherein said payout means includes means for delivering a preselected quantity of said tokens as a function of said at least one wager.

6. A gaming apparatus in accordance with claim 1, wherein the distance between an upstanding pin and the associated said crown is less than the radius of said movable elements, the distance between said crown and the associated said stepped portion is less than said radius of said movable elememts, and the distance between said upstanding pin and the associated said stepped portion is greater than the radius of said movable elements.

7. A gaming apparatus in accordance with claim 1, wherein said randomization means further comprises semi-resilient walls defining boundries for selected portions of said inclined path means, whereby said movable elements may interact with said semi-resilient walls during the travel thereof between said designated starting and finishing position.

8. A gaming apparatus in accordance with claim 1, wherein said inclined path means comprises a pluraity of successive elongated inclined surfaces.

9. A gaming apparatus in accordance with claim 8, wherein said elongated inclined surfaces are each rectangular in shape and are disposed such that the longitudinal axis of each of said elongated inclined surfaces is perpendicular to the longitudinal axis of other said elongated inclined surfaces abutting the ends thereof.

10. A gaming apparatus in accordance with claim 9, wherein said randomization means further comprises semi-resilient walls defining boundaries for selected portions of said elongated inclined surfaces, whereby said movable elements may interact with said semi-resilient walls during the travel thereof.

11. A gaming apparatus in accordance with claim 1, further comprising transporting means for transporting said movable elements from said finishing position to said starting position.

12. A gaming apparatus in accordance with claim 1, wherein said determination means comprises identifying means for identifying said visible identification characteristics of each of said group of movable elements.

13. A gaming apparatus in accordance with claim 12, wherein said visible identification characteristics comprises each of said movable elements being of a different color.

14. A gaming apparatus in accordance with claim 13, wherein said identifying means identifies the color of each of said movable elements.

15. A game apparatus, wherein movable elements roll down an inclined surface visible to the user and free of any user influence comprising:
a visible inclined surface having an upper end and a lower end and a plurality of stepped portions therebetween;
a plurality of user independent deflecting pins mounted within a distance of approximately twice the diameter of one of said movable elements from one of said stepped portions for altering the speeds and paths of said movable elements as said movable elements roll from said upper end to said lower end of said inclined surface; and
a plurality of semi-spherical crowns mounted on said inclined surface between one of said stepped portions and one of said deflecting pins such that a movable element rolling from said upper end to said lower end passes over one of said stepped portions and one of said crowns and then encounters one of said deflecting pins associated therewith.

16. A gaming apparatus in accordance with claim 15, wherein the distance between each of said deflecting pins and the associated one of said crowns is less than the radius of said movable elements, the distance between each of said crowns and the associated said stepped portions is less than said radius of said movable elements, and the distance between each of said deflecting pins and the associated said stepped portion is greater than said radius of said movable elements.

17. A gaming apparatus in accordance with claim 16, wherein selected said stepped portions are elongated and include a rounded edge proximate to an associated one of said crowns.

* * * * *